US005505029A

United States Patent [19]

Lind

[11] Patent Number: 5,505,029

[45] Date of Patent: Apr. 9, 1996

[54] FIXING SYSTEM FOR FACING PANELS

[75] Inventor: Stefan Lind, Waldachtal, Germany

[73] Assignee: fischerwerke, Artur Fischer GmbH & Co KG, Waldachtal, Germany

[21] Appl. No.: 352,557

[22] Filed: Dec. 8, 1994

[30] Foreign Application Priority Data

Dec. 15, 1993 [DE] Germany ..... 43 42 748.0

[51] Int. Cl.[6] ..... E04B 2/88

[52] U.S. Cl. ..... 52/235; 52/489.1; 52/126.3

[58] Field of Search ..... 52/235, 483.1, 52/489.1, 126.3, 126.4, 506, 508, 510

[56] References Cited

U.S. PATENT DOCUMENTS

| | | | |
|---|---|---|---|
| 4,845,909 | 7/1989 | Bailey | 52/235 |
| 4,873,805 | 10/1989 | Ting | 52/235 |

FOREIGN PATENT DOCUMENTS

| | | | |
|---|---|---|---|
| 2659999 | 9/1991 | France . | |
| 3527224 | 2/1987 | Germany . | |
| 3817072 | 12/1988 | Germany . | |
| 3743024 | 6/1989 | Germany . | |
| 3926816 | 3/1991 | Germany . | |
| 9214581 | 1/1993 | Germany . | |
| 1350291 | 11/1985 | U.S.S.R. . | |
| 2127452 | 4/1984 | United Kingdom | 52/235 |
| 2157338 | 10/1985 | United Kingdom | 52/235 |

*Primary Examiner*—Carl D. Friedman
*Assistant Examiner*—Yvonne Horton-Richardson
*Attorney, Agent, or Firm*—Michael J. Striker

[57] ABSTRACT

The fixing system for facing panels (1) consists of a substructure fixed to a wall. The substructure has supporting elements (6) on which profiled panel supports (2) connected to the rear side of the facing panels can be hung. The supporting elements (6) include, for each facing panel element (5), one locating supporting element (7) and at least three non-locating supporting elements (8). The locating supporting element (7) is preferably arranged in an upper corner region of a facing panel element (5) and is fixedly connected to the corresponding profiled panel support (2) of the facing panel element (5). Furthermore, the locating supporting element (7) has an adjusting means allowing horizontal and vertical adjustment. The non-locating supporting element (8), preferably at the other top corner region of the facing panel element (5), is likewise provided with an adjusting means for vertical adjustment. The fixing system according to the invention allows easy mounting and orientation of the facing panels, and is a statically defined system, which avoids stresses caused by thermal expansion within the system.

8 Claims, 8 Drawing Sheets

FIXING SYSTEM FOR FACING PANELS

BACKGROUND OF THE INVENTION

The present invention relates to a fixing system for facing panels.

Various fixing systems for facing panels are known. The facing panels are mounted on a substructure by profiled panel supports secured to the rear side of the facing panels. The known substructures are relatively awkward to construct and mount, since they are not matched to the rear-side anchoring points between the facing panel and the profiled panel supports. Moreover, the known fixing systems are statically undefined systems, since the facing panels are fixedly clamped to the profiled panel supports and/or the profiled panel supports are fixedly clamped to the substructure at least at two fixing points. Because of the different thermal expansion of the substructure on the one hand and of the facing panels on the other hand, the stresses that occur in the fixing system are therefore considerable and lead to additional strains on the fixing elements anchored in the facing panel. As a result, damage to the fixing system and to the facing panels is likely to occur. Moreover, in a fixing system for facing panels it is necessary for the individual facing panels, or rather facing panel elements formed by several facing panels, to be adjustable to achieve similar gap widths and coplanar facing surfaces.

SUMMARY OF THE INVENTION

It is an object of the present invention to provide a fixing system for facing panels, which simplifies mounting of facing panels, enables the facing panels to be adjusted and which is statically definite because of avoidance of stresses caused by thermal expansion.

According to the invention, the system for mounting facing panels on a wall consists of a substructure attached to the wall and on which the facing panels are supported. The substructure comprises a plurality of profiled panel supports attached to a rear side of a facing panel to form a facing panel element; a plurality of supporting elements including a locating supporting element and at least three non-locating supporting elements for the facing panel element, the locating supporting element being fixedly connected to one of the profiled panel supports of the facing panel element; means for horizontally and vertically adjusting the facing panel element with respect to the locating supporting element, the means for horizontally and vertically adjusting being provided with the locating supporting element; and means for vertically adjusting the facing panel element with respect to one of the non-locating supporting elements provided with that non-locating supporting elements.

According to the invention, the supporting elements fixed to the substructure have a locating supporting element and at least three non-locating supporting elements for each facing panel or facing panel element, which may comprise one or more facing panels. Using the locating supporting element, the facing panel element is fixedly secured at one point to the substructure and is able to compensate for the different thermal expansions of the facing panel element and substructure at the three other non-locating supporting elements. With standard panel thicknesses and a facing panel element formed with one facing panel, four fixing points are normally sufficient, but a suitable adaptation can be effected by using further non-locating supporting elements if relatively large facing panel elements are involved. In cases where there are four fixing points, the locating supporting element is advantageously arranged at a top corner region of a facing panel element; with six or more fixing points, fixing could also be effected in the center of the top series of fixing points. Means for horizontal and vertical adjustment of the facing panel element are provided on the locating supporting element. A non-locating supporting element, which is likewise vertically adjustable for the orientation of the facing panel element, is advantageously arranged in the other top corner region of the facing panel element. Further non-locating supporting elements which may possibly be arranged in the upper row of fixing points and the non-locating supporting elements arranged in the lower row of fixing points support the facing panel element and mount it on the substructure. There is no need for further adjustment at these non-locating supporting elements.

According to a preferred embodiment, the supporting elements are in the form of U-shaped members which face towards the facing panel elements with their open side, and which have a bolt mounted in the two arms for the engagement of the profiled panel support. The profiled panel supports provided with correspondingly shaped apertures engage these bolts and are thus held by the bolt. Vertical adjustment can be effected by suitable adjusting means which bear against the bolt.

In a preferred embodiment, at least the locating supporting element and one non-locating supporting element have in the bolt a central transverse threaded hole for vertical adjustment. In this manner, using a screw engaging in the threaded hole and bearing against an additional bolt arranged between the arms of the U-shaped member, a vertical adjustment can be effected. The locating supporting element furthermore has screw elements arranged on its arms for horizontal adjustment on the one hand and for fixing the profiled panel support to the locating supporting element on the other hand. Using this type of fixing, the locating bearing on the supporting element is formed.

Apertures for mounting on the supporting elements are provided at the top and bottom ends of the elongate profiled panel support. These apertures can be provided, for example, when the profiled panel support has a hook-shaped structure at its top end to engage with the bolts of the upper supporting elements. At the lower end of the profiled panel support the aperture is slot-shaped, so that the profiled panel support is able to engage over the bolt of the lower supporting element and rest on this. Using such profiled panel supports, several facing panels can be secured to two profiled panel supports and thus form the facing panel element.

According to an additional preferred embodiment, the facing panels are fixedly secured at one point at an adjustable distance from the profiled panel supports to respective profiled panel supports and are loosely secured thereto at least at one other point. The loose mounting is effected using a mounting element which is secured in a throughgoing hole in the profiled panel support with some play or freedom of movement in the axial and radial direction. In this manner, different thermal expansions of the facing panels, on the one hand, and the profiled panel supports, on the other hand, can be accommodated and stresses can be avoided.

Using the above-described fixing system according to the invention, mounting is rapid, with the ability to replace or exchange if damage occurs. The facing panels can be oriented to provide a smooth and uniform facing surface with equal joint spacings. Moreover, preassembled facing panels can be used. Furthermore, the fixing system according to the invention is a statically defined system in which stresses as a result of different thermal expansion of the facing panels and the profiled panel supports and of the substructure are unable to occur.

BRIEF DESCRIPTION OF THE DRAWING

The objects, features and advantages of the present invention will now be illustrated in more detail by the following detailed description, reference being made to the accompanying drawing in which.

DESCRIPTION OF THE PREFERRED EMBODIMENTS

Figure 1:
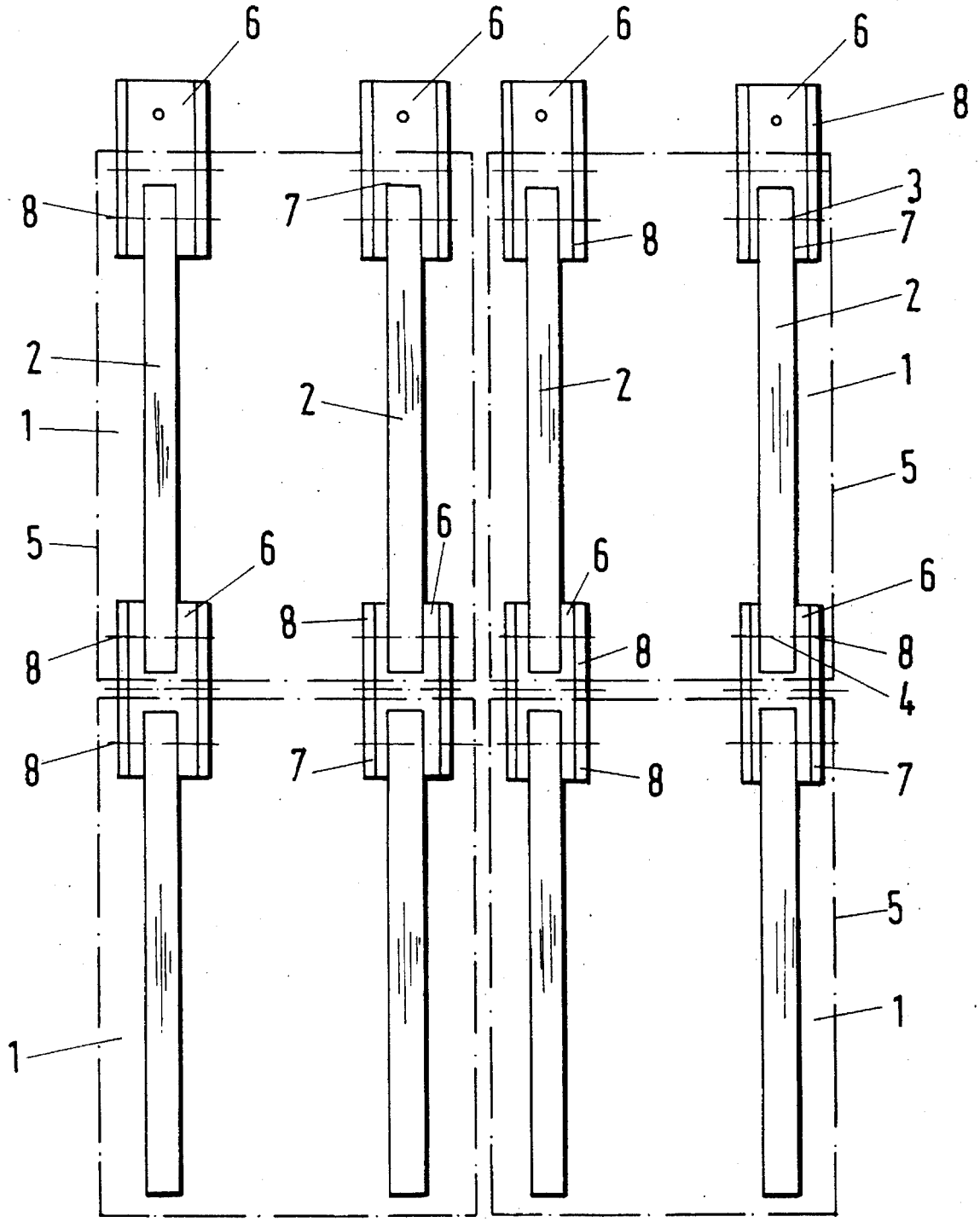
FIG. 1 is a diagrammatic representation of four facing panel elements, each having a pair of profiled panel supports.

FIG. 1 shows the fixing system with facing panels 1, each of which is connected to two profiled panel supports 2. In the region of their upper ends, at points 3 of the particular profiled panel support, the facing panels 1 are fixedly connected to the profiled support. In the region of its lower end, at the points 4, the particular facing panel 1 is loosely connected with play to the profiled panel supports 2. Together with the profiled panel supports 2, the facing panel 1 forms a facing panel element 5, which is hung on the supporting elements 6 that are fixed in the substructure. In the embodiment illustrated here, the supporting elements 6 are designed to act, on the one hand, as the upper supporting means for a lower panel, and, on the other hand, as the lower supporting means for an upper panel. A supporting element 6, which comprises a locating supporting element 7 and a non-locating supporting element 8, is provided for each facing panel element 5, preferably at one of the two upper corners. The facing panel element 5 is fixed by the locating supporting element 7. In addition, a horizontal and vertical adjustment is possible at the locating supporting element 7. Vertical adjustment is further effected by the non-locating supporting element 8 arranged in the region of the other top corner. No adjustment facility is provided for the lower non-locating supporting elements 8 of a facing panel element 5. The fixing system described in FIG. 1 therefore guarantees a statically defined system with one fixed point and three non-fixed points of the facing panel element 5 and one fixed point and one non-fixed point of a profiled panel support 2 with the facing panel 1.

Figure 2:
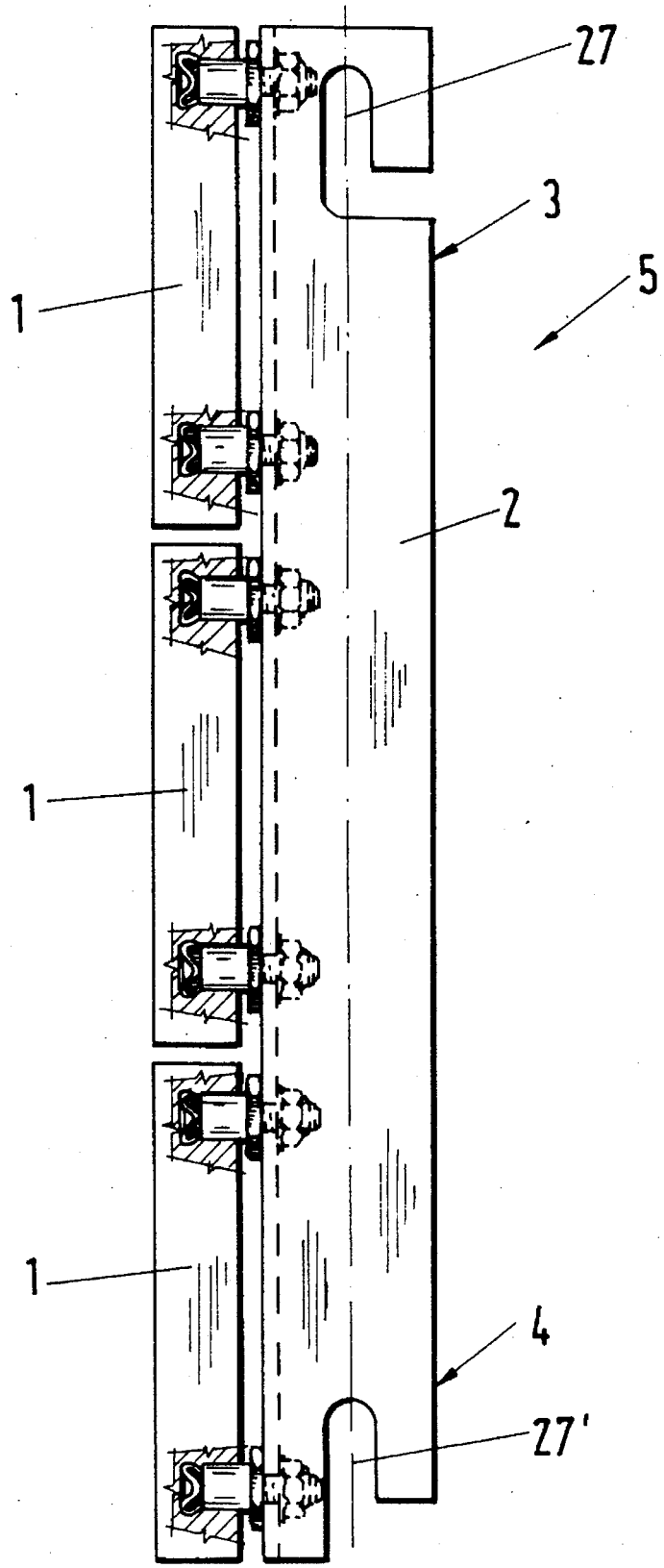
FIG. 2 is a side view of a facing panel element with several facing panels.

FIG. 2 shows a side view of a facing panel element 5 with several facing panels 1, each of which, as described with reference to FIG. 1, can be fixedly secured to the profiled panel support 2 at one point and loosely secured at least at one further fixing point. A facing panel element 5 of that structure enables the element to be preassembled at the factory, resulting in a quicker mounting on site with comparatively fewer mounting devices on the wall.

Figure 3:
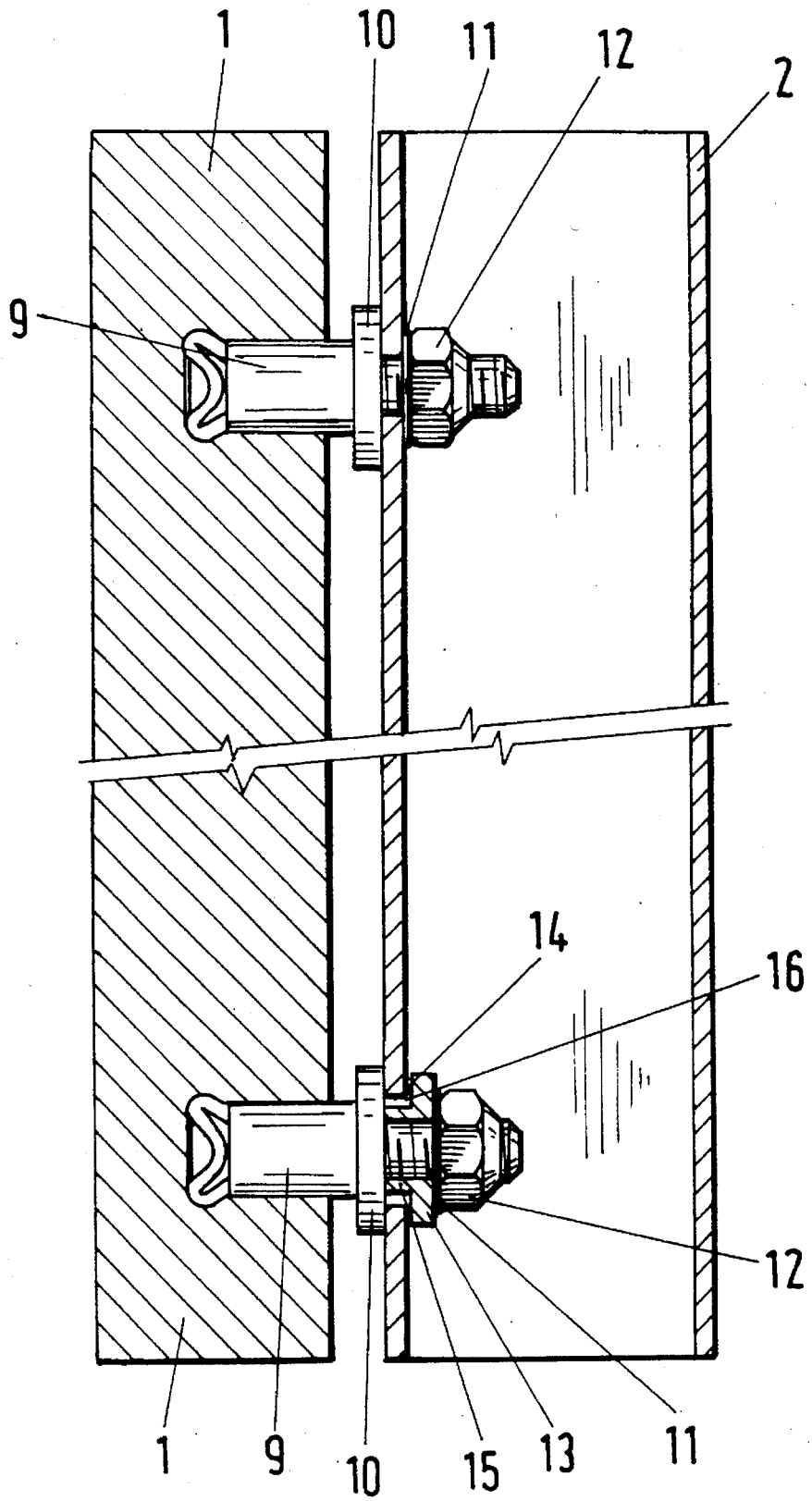
FIG. 3 is a side cross-sectional view through one embodiment of a facing panel fixed to the profiled panel support.

FIG. 3 shows how a facing panel 1, preferably of a thickness of at least 30 mm, is mounted on a profiled panel support 2. The upper fixed connection of the facing panel 1 takes place by a stand-off mounting anchor 9 which is fixed in the facing panel 1. The constant distance between the profiled panel support 2 and the facing panel 1 is guaranteed by the spacer washer 10 which is screwed onto the thread of the stand-off mounting anchor 9. Fixing to the profiled panel support 2 is effected by customary fixing means, such as washer 11 and nut 12. The lower, loose connection between the facing panel 1 and the profiled panel support 2 is achieved by an additional spacer piece 13, the external diameter of which is smaller than the internal diameter of the throughgoing hole 14. For freedom of movement in the axial direction, the spacer piece 13 is structured so that its region 15 engaging in the hole 14 is longer than the wall thickness of the profiled panel support 2. This structure provides a gap 16 between the spacer piece 13 and the profiled panel support 2, which allows freedom of movement or some play in the axial and radial direction. Fixing is again effected by a washer 11 and nut 12.

Figure 4:
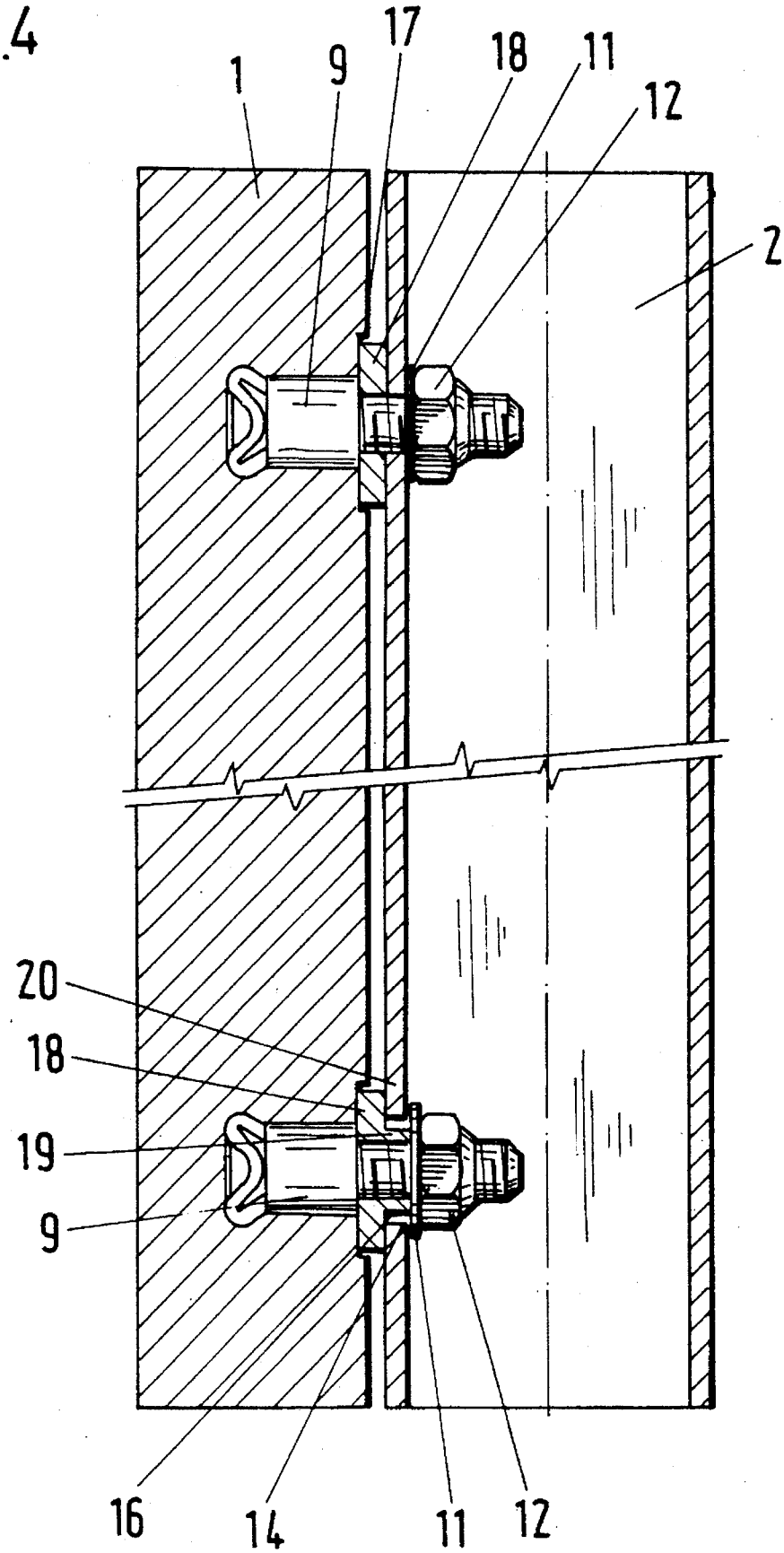
FIG. 4 is a side cross-sectional view through another embodiment of a facing panel fixed to the profiled panel support.

FIG. 4 shows how a facing panel 1 of relatively small thickness is fixed to a profiled panel support 2. The facing panel 1 and the profiled panel support 2 are spaced a predetermined distance from each other by a spacer piece 18 arranged in a recess 17 of the facing panel 1. In FIG. 4, the facing panel 1 is again fixedly attached to the profiled panel support 2 at the top and loosely connected or attached at the bottom. The loose connection at the bottom also includes a spacer sleeve 19, which is longer than the thickness of the wall 20 of the profiled panel support 2. Corresponding to the embodiment in FIG. 3, the external diameter of the spacer sleeve 19 is also smaller than the internal diameter of the bore 14, so that a gap 16 is again produced which allows axial and radial movement within certain limits.

Figure 5:
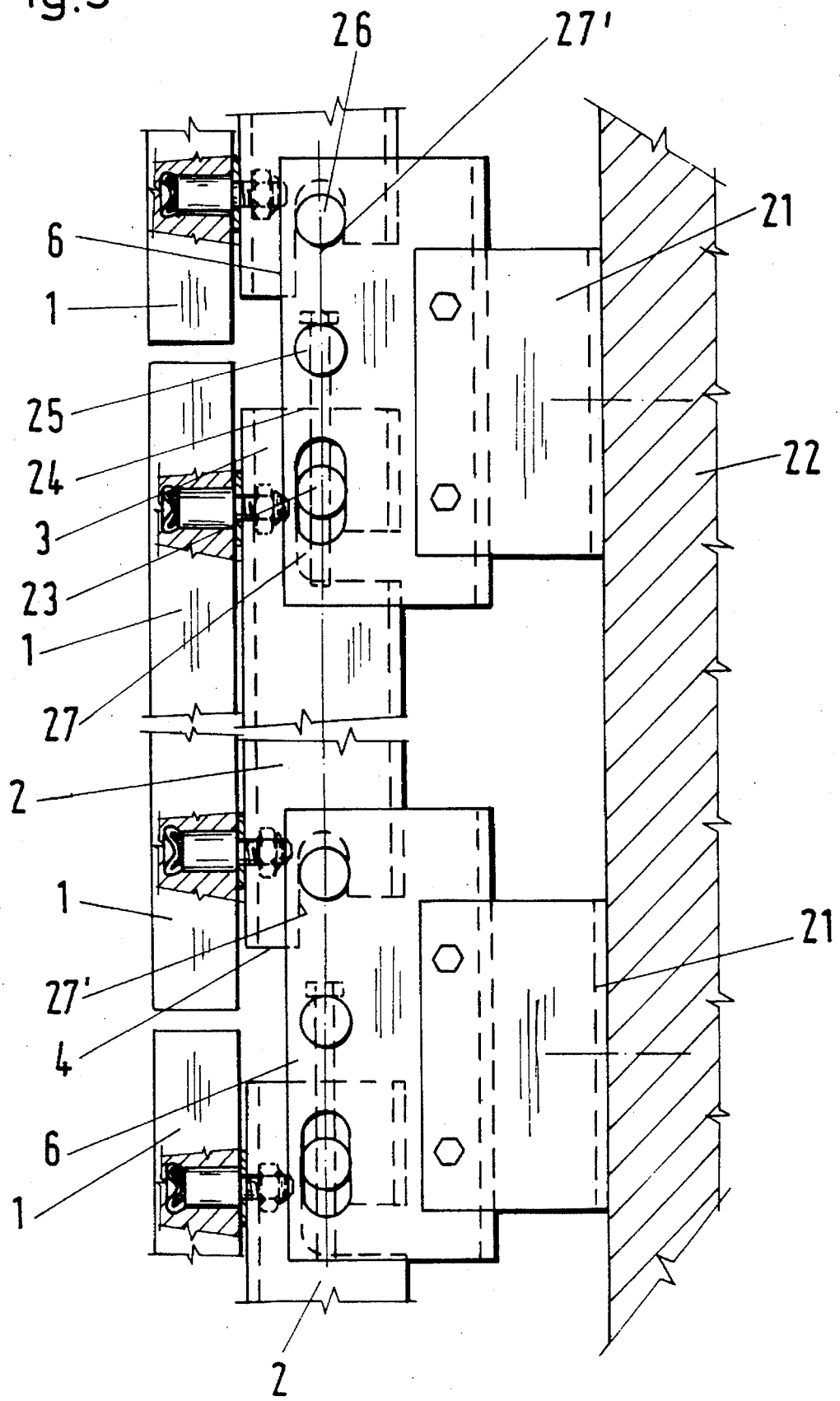
FIG. 5 is a diagrammatic side view of a facing substructure.

FIG. 5 is a side view of the fixing system with the facing panels 1 which are fixed by profiled panel supports 2, supporting elements 6 and wall mounts 21 to the wall 22 of a building. The profiled panel supports 2 have a hook-shaped structure at their upper end 3 because of a suitable recess 27 and engage over a bolt 23 which is mounted in the supporting element 6. Vertical adjustment of the profiled panel support 2, and consequently of the facing panel element 5, is effected by a vertical adjustment screw 24 which runs through a bore in the bolt 23 and a bore in an additional bolt 25. The supporting element 6 has yet another bolt 26 in the embodiment, which supports the particular profiled panel support 2 over it. The profiled panel support 2 additionally has at its lower end 4 a slot-shaped recess 27' in which the bolt 26 engages. The U-shaped supporting element 6 is secured to the wall 22 by a wall mount 21, which is likewise U-shaped.

Figure 6:
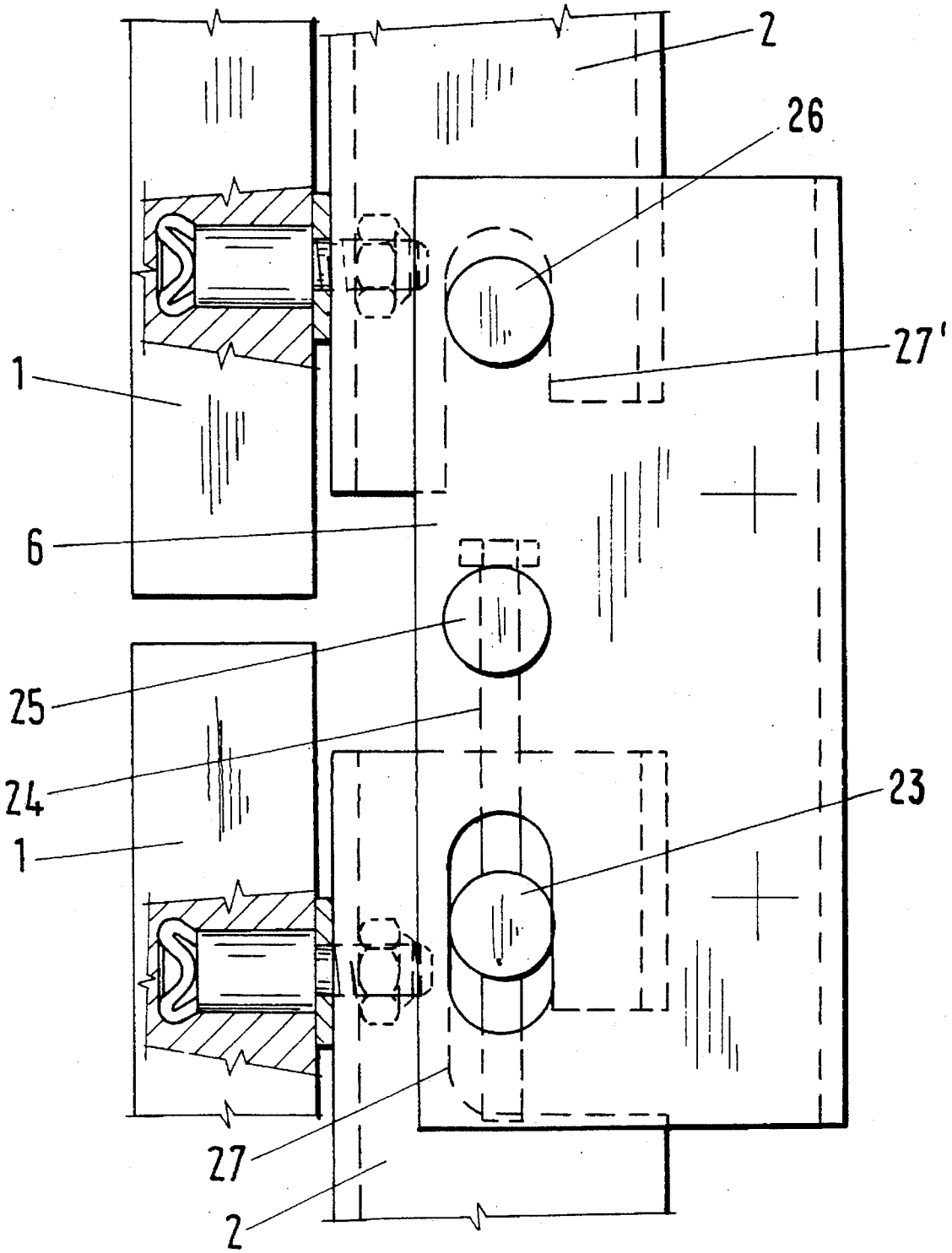
FIG. 6 is a detailed side view of a supporting element.

FIG. 6 again shows an enlarged supporting element 6, with the upper bolt 26, the lower bolt 23 and the bolt 25 and the vertical adjustment screw 24.

Figure 7:
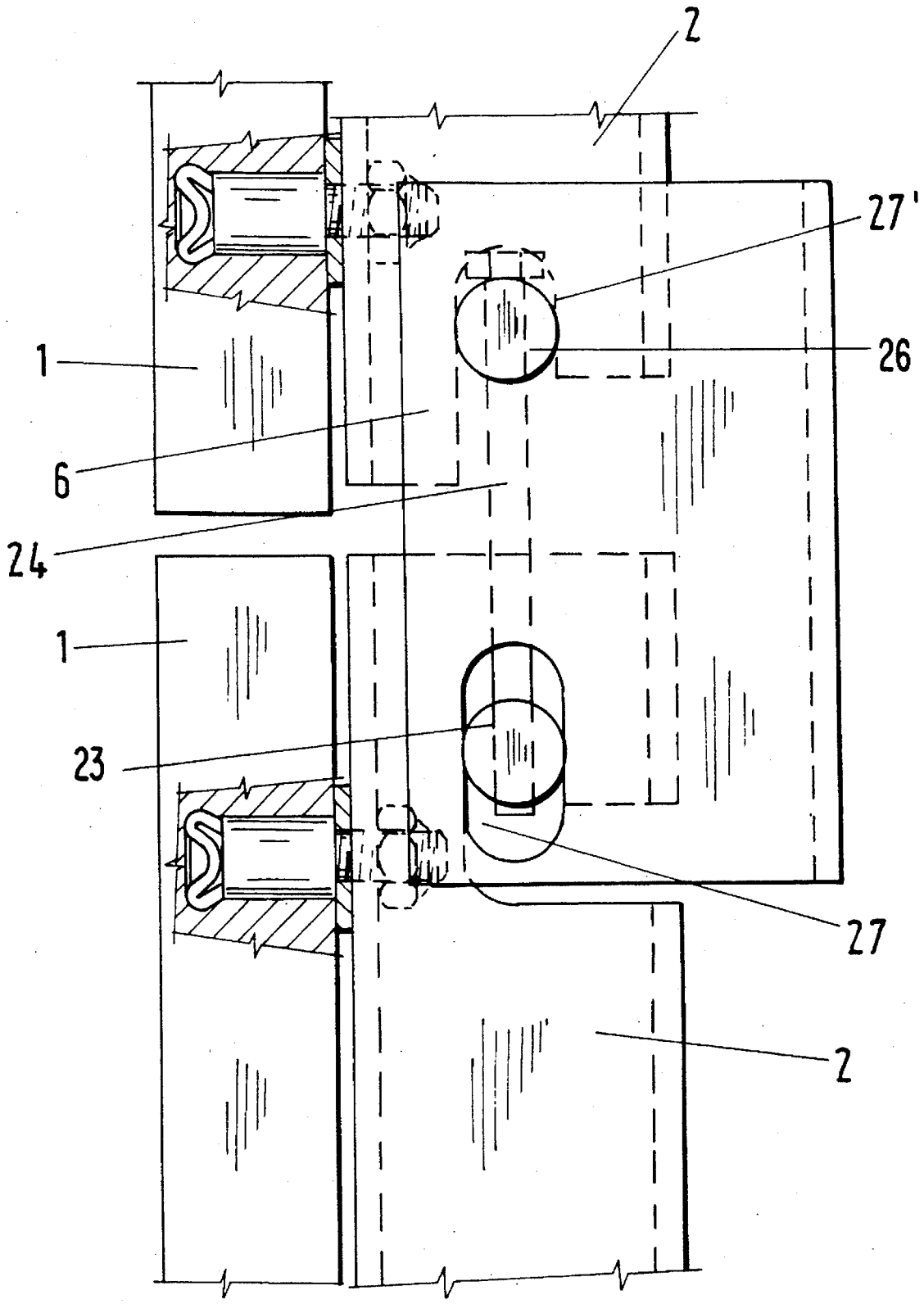
FIG. 7 is a detailed side view of another supporting element having different vertical adjustment means than the supporting element of FIG. 6.

FIG. 7 shows another structure of the supporting element 6 in which the middle bolt 25 has been omitted and the upper bolt 26 has been provided with a corresponding bore for the vertical adjustment screw 24.

Figure 8:
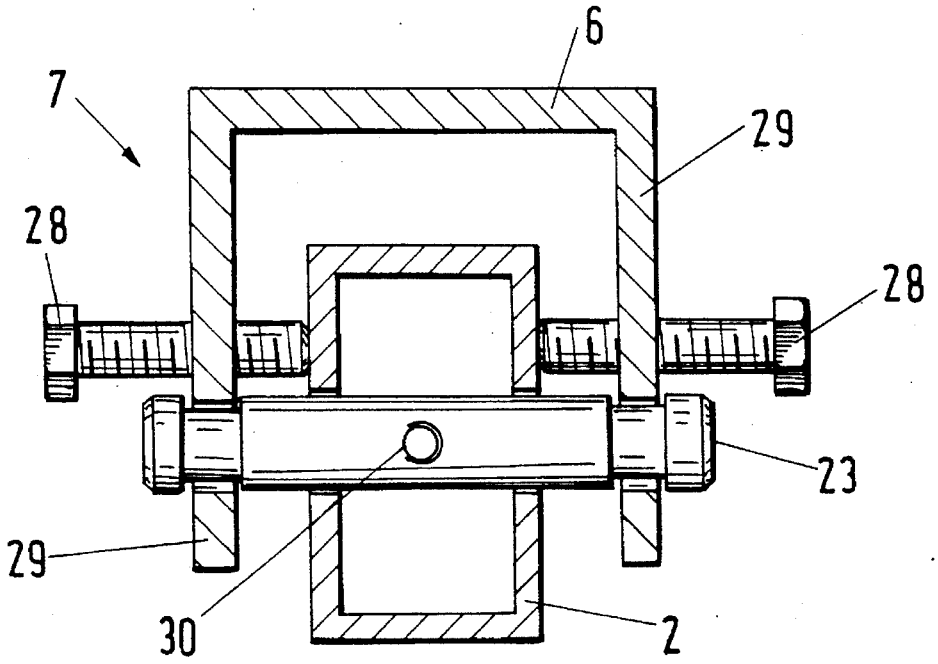
FIG. 8 is a cross-sectional view through a locating supporting element.
Figure 9:
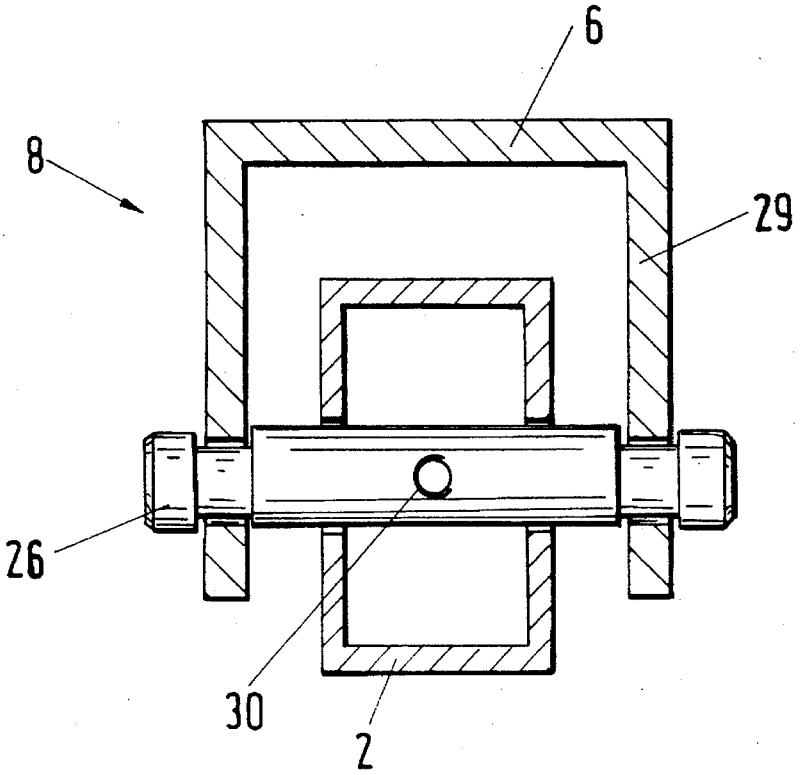
FIG. 9 is a cross-sectional view through a non-locating supporting element.

FIG. 8 shows a locating bearing which serves to connect the profiled panel support 2 fixedly to the supporting element 6. As illustrated in the previous FIGS. 6 and 7, the profiled panel support 2 is hung by its upper end on a bolt 23, in order to be fixed there at one point for each facing panel element. Fixing of the profiled panel support 2 is effected by means of adjusting and clamping screws 28 which are arranged in corresponding bores in the arms 29 of the U-shaped supporting element 6. By means of the adjusting and clamping screws 28, a horizontal adjustment of the profiled panel support 2, or rather the facing panel element 5, can be effected. The bolt 23 has a transversely extending bore 30 for the vertical adjustment screw. The loose mounting of the profiled support 2 in FIG. 9 is correspondingly constructed. In this structure, no adjusting and clamping screws are provided. The arrangement illustrated in FIG. 8 therefore represents a locating supporting element 7 and the arrangement illustrated in FIG. 9 represents a non-locating supporting element 8. The individual supporting elements can be used either as separate elements, or in combination with one another, as illustrated in the Figures of the embodiments.

While the invention has been illustrated and described as embodied in a fixing system for facing panels, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

I claim:

1. A system for mounting facing panels on a wall consisting of a substructure attached to the wall and on which said facing panels are supported, said substructure comprising a plurality of profiled panel supports (2) attached to a rear side of at least one facing panel (1) to form a facing panel element (5);

a plurality of supporting elements (6) including a locating supporting element (7) and at least three non-locating supporting elements (8) for said facing panel element (5), the locating supporting element (7) being fixedly connected to one of the profiled panel supports (2) of said facing panel element (5);

means for horizontally and vertically adjusting said facing panel element with respect to said locating supporting element (7), said means for horizontally and vertically adjusting being provided with said locating supporting element (7); and means for vertically adjusting said facing panel element with respect to one of said non-locating supporting elements (8) provided with said one of the non-locating supporting elements (8).

2. A fixing system as defined in claim 1, wherein said locating supporting element (7) fixedly connected to the panel support (2) is arranged in an upper region of the facing panel element (5).

3. A fixing system as defined in claim 1, wherein said non-locating supporting element (8) connected to the panel support (2) is arranged in an upper region of the facing panel element (5).

4. A fixing system as defined in claim 1, wherein the supporting elements (6) are each in the form of a U-shaped member having an open side and are each oriented so that said open side faces towards the facing panel element (5), and each of said supporting elements (6) is provided with two arms (29) and a bolt (23, 26) mounted in the two arms (29) for engagement with one of the profiled panel supports (2).

5. A fixing system as defined in claim 4, wherein said means for horizontally and vertically adjusting said facing panel element (5) with respect to said locating supporting element (7) comprises said bolt (23,26) and a vertical adjusting screw (24) engaged in a central transverse threaded bore (30) provided in said bolt for adjusting vertically, and screw elements (28) passing through said arms (29) of said locating supporting element (7) and engaging with the profiled panel support (2) associated with said locating supporting element (7) for adjusting horizontally.

6. A fixing system as defined in claim 4, wherein said means for vertically adjusting said facing panel element with respect to said one of said non-locating supporting elements (8) comprises said bolt (23,26) and a vertical adjusting screw (24) engaged in a central transverse threaded bore (30) provided in said bolt for adjusting vertically.

7. A fixing system as defined in claim 1, wherein each of the profiled panel supports (2) is provided with recesses (27, 271) arranged at the top (3) and bottom (4) end thereof for mounting the profiled panel supports (2) on the supporting elements (6).

8. A fixing system as defined in claim 1, wherein the at least one facing panel (1) is fixedly attached at one point to one of said profiled panel supports (2) and spaced at an adjustable distance therefrom and is loosely secured thereto at least at one additional point, and further comprising a mounting element at each of said additional points loosely secured in a bore (14) in said profiled panel support (2) with axial and radial play.

* * * * *